United States Patent [19]

Foulkes

[11] 4,045,762

[45] Aug. 30, 1977

[54] REMOTE CONTROL FUSE CLOSING DEVICE

[75] Inventor: John F. Foulkes, Elmhurst, Ill.

[73] Assignee: S&C Electric Company, Chicago, Ill.

[21] Appl. No.: 615,061

[22] Filed: Sept. 19, 1975

[51] Int. Cl.[2] ..... H01H 37/76

[52] U.S. Cl. ..... 337/401; 200/61.08

[58] Field of Search ..... 200/61.08, 48 R, 48 SB; 337/401, 155, 402; 60/632, 635

[56] References Cited

U.S. PATENT DOCUMENTS

| | | | |
|---|---|---|---|
| 3,190,990 | 6/1965 | Perry | 200/61.08 |
| 3,810,060 | 5/1974 | Hubbard | 337/155 |

*Primary Examiner*—Harold Broome

*Attorney, Agent, or Firm*—Kirkland & Ellis

[57] ABSTRACT

A small expendable rocket engine is attached to an electrical switching element and ignited to provide propelling force to open or close the switching element into or out of a circuit. An electrical ignition system attached to the rocket engine can be actuated remotely to ignite the rocket engine either by a relay switch or by the lineman using an insulative cord so that the lineman is remotely positioned when the switching element is closed into the circuit. The rocket engine is expendable and can either be removed from the switching element after operation by dislodging it by pulling on the cord, or a releasable connector can be used to connect the rocket engine to the switching element so that the rocket engine automatically disengages the switching element after operation. The rocket engine may be left in place after switching operation on the switching element if its presence will not adversely affect normal operation of the switching element. The rocket engine may also be ignited by the operation of automatic control circuitry to provide automatic unattended high speed operation of the switching element.

14 Claims, 13 Drawing Figures

FIG-3
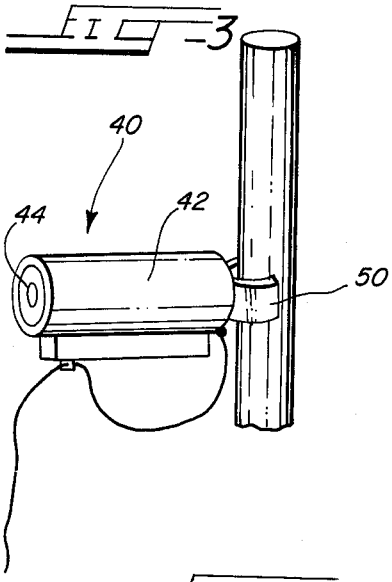
FIG-4
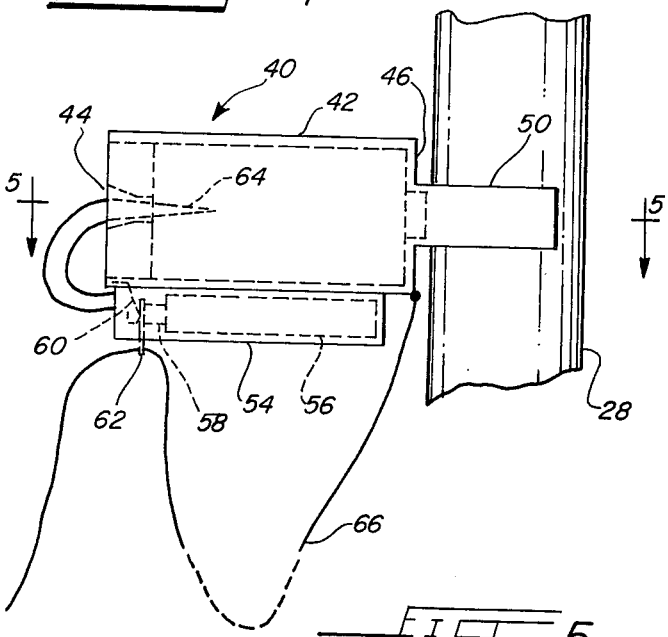
FIG-6
FIG-5
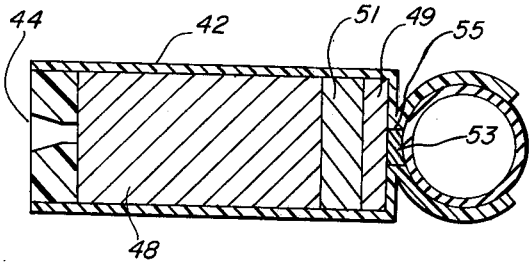
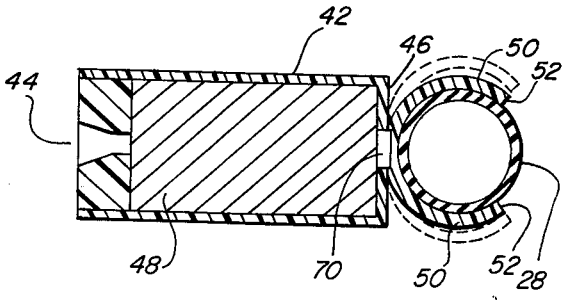
FIG-7
FIG-8
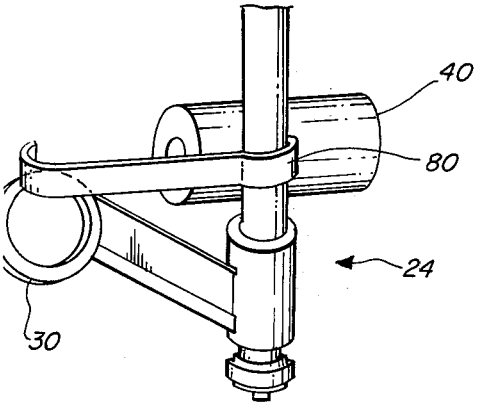
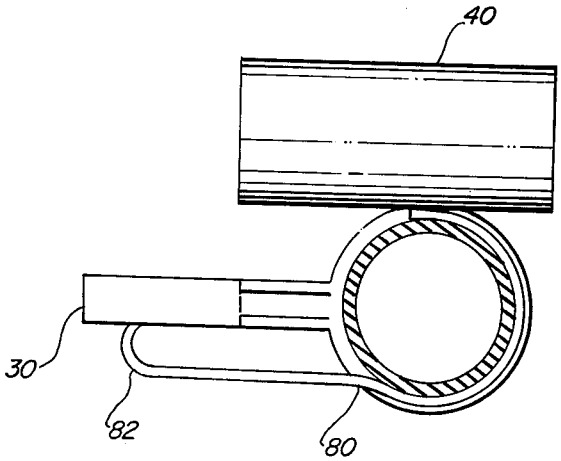

REMOTE CONTROL FUSE CLOSING DEVICE

BACKGROUND OF THE INVENTION

1. Field of the Invention

The present invention relates to devices for operation of switching elements in an electrical circuit, and more particularly, the present invention relates to remote controlled rocket devices for providing propelling forces to provide high speed operation of switching elements in an electrical circuit where either attended or unattended operation is required.

2. Description of the Prior Art

In recent years electric utilities have experienced difficulty in providing adequate protection for operating personnel when closing switching devices with conventional operating tools to energize overhead distribution transformers. A combination of new practice in transformer design, traditional fusing practice, higher fault current levels, and higher distribution voltages has led to explosive failures of transformer tanks resulting from internal arcing faults. Such arcing faults within the transformer's insulating oil generate an internal pressure build-up within the tank due to "let-through" current of the protective device, sometimes resulting in tank rupture or transformer cover being disruptively blown off the tank. It is evident, therefore, that, as an alternative to installing new circuit protective devices to restrain the level of the "let-through"current, the safety of operating personnel would be enhanced by the use of a tool which can be installed on most existing conventional switching devices (such as fuse cutout and power fuses as typically utilized for protection of overhead transformer installations) and which facilitates the closing of said switching devices from remote locations.

One type of prior art device which is utilized to achieve a similar safety factor is described in U.S. Pat. No. 3,810,060. This device is a portable tool consisting of a conventional switching element (fuse cutout) especially fitted with lever and lanyard rigged to the ground through a pulley mounted near the base of the transformer pole to facilitate an approximate 90° translation in the force exerted on the lanyard, thereby allowing personnel located at ground level and at considerable distance away from the base of the pole to close the switching element by pulling the lanyard. Following successful energization of the transformer, the permanently mounted conventional transformer protective device must be closed electrically in parallel with the portable tool in the conventional manner using a conventional switch operating tool. The portable tool and its rigging must then be manually removed.

Another type of prior art device consists of the use of a current limiting fuse as a portable tool for closing the circuit. Following successful energization of the transformer through the current-limiting fuse (specifically selected to preclude a disruptive transformer failure), the permanently mounted conventional transformer protective device is electrically closed in parallel. Finally, as in the above example, the portable tool must be manually removed from the overhead line.

Accordingly, it would be a beneficial advance to the art to provide an inexpensive, convenient and expendable device for manually closing the permanently installed conventional transformer switching element such as fuse cutout or power fuse from a remote location without the need to spend time and effort to recover the tool and related equipment.

Also, for many years electric utilities have utilized high-speed grounding switches to convert relay-detected low-level, secondary-side transformer faults into heavy primary-side ground fault capable of being detected and cleared by the source circuit breakers. Following such clearing of both faults, an automatically controlled disconnect switch isolates both the faulted transformer and the closed high-speed grounding switch, thereby allowing the source circuit breaker to reclose in order to restore service to the unaffected loads fed by the same source. Additionally, three-pole, high-speed grounding switches are utilized to convert a relay-detected, low-level transformer fault into a heavy ground fault in order to force simultaneous operation of, and effect isolation by, all three fuses feeding a three-phase transformer.

In order to minimize outage time for unaffected loads as well as to minimize fault damage to the affected transformer, high speed is an obvious requirement. Presently, high-speed grounding switches close by means of a solenoid releasing the energy of a torsional spring to propel the switch blade. Accordingly, it would be a beneficial advance to the art to provide a less expensive, yet higher speed grounding switch powered by an electrically ignited rocket engine (or the cluster of engines as may be required to attain the desired speed) in lieu of a heavy-duty spring and solenoid-release mechanism.

BRIEF DESCRIPTION OF THE INVENTION

In accordance with the present invention a device for operating a circuit switching element in an electrical circuit comprises a propellant means for generating forces in response to external activation of an activating means to cause the switching element to move to effectuate switching operation. A connector means is provided to connect the propellant means to the switching element, and the connector means may be adapted to permit the propellant means to be disengaged from the switching element without requiring the utility lineman to return to the close proximity of the switching element. Activating means allows activation of the propellant means in response to remote actuation. Typically, a long insulative cord is connected to the propellant means and is utilized to activate the propellant means by the utility lineman from a remote position and to allow the lineman to disengage the propellant means from a remote position by pulling on the cord. The activating means may also be activated by an external device or control device such as a protective relay. Typically, the relay closes in response to a transformer fault, thereby activating the propellant means to close a high-speed grounding switch. In this arrangement, the propellant device is essentially permanently wired to the relay and must be replaced after each operation.

Accordingly, it is a primary object of the present invention to provide a device for operating a switching element in an electrical circuit utilizing propellant forces to operate the switching element.

A further object of the present invention is to provide a simple and convenient device for manually operating a switching element of an electrical circuit from a remote position.

It is a further object of the present invention to provide a simple inexpensive device for operating a switching element in an electrical circuit utilizing a small expandable rocket engine that can be remotely activated.

A further object of the present invention is to provide a device for operating a switching element in an electrical circuit which may be automatically disengageable from the switching element after operation so that a utility lineman is not required to approach the switching element to remove the device.

Yet another object of the present invention is to provide a device for actuation of a switching element of an electrical circuit by automatic control.

A further object of the present invention is to provide a device for propellant operation of switching elements either automatically or by remote manual control which is attachable and applicable to a wide variety of sizes and shapes of switching elements.

These and other objects, advantages, and features of the present invention will hereinafter appear, and for the purposes of illustration, but not of limitation, exemplary embodiments of the present invention are illustrated in the accompanying drawings.

BRIEF DESCRIPTION OF THE DRAWINGS

FIG. 3 is a side perspective view of an alternative embodiment of the present invention attached to a conventional fuse.

FIG. 4 is a side view of the embodiment illustrated in FIG. 3.

FIG. 5 is a cross-sectional view taken substantially along line 5—5 in FIG. 4.

FIG. 6 shows an alternative embodiment of a connecting means for the present invention.

FIG. 7 shows another alternative embodiment of a connecting means for the present invention.

FIG. 8 is a top view of the connecting means illustrated in FIG. 7.

DETAILED DESCRIPTION OF THE PREFERRED EMBODIMENTS

Figure 1:
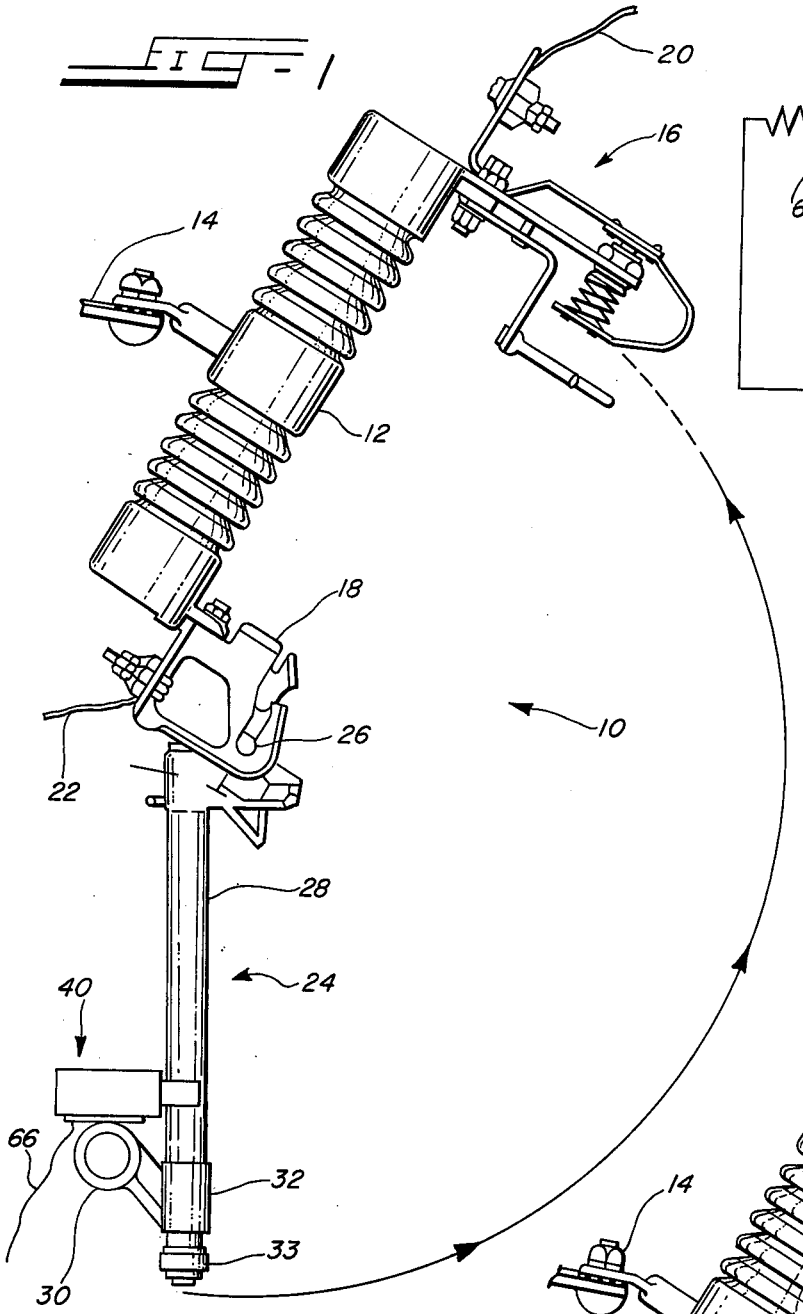
FIG. 1 is a side elevational view of a conventional fuse cutout with a preferred embodiment of the present invention attached.

With reference to FIG. 1 a conventional fuse cutout 10 comprises insulator 12 mounted by bracket 14 to a utility pole (not shown) or any other suitable mounting. Mounted at one end of insulator 12 is first terminal assembly 16, and mounted at the opposite end of insulator 12 is second terminal assembly 18. Attached to first terminal assembly 16 is an electrical conductor 20 which is connected to one portion of a high voltage electrical circuit, and attached to second terminal assembly 18 is another electrical conductor 22 which is connected to another portion of a high voltage electrical circuit.

Pivotably mounted to second terminal assembly 18 is fuse assembly 24. Fuse assembly 24 is a conventional high voltage fuse having a pivot pin connection 26 at one end engaging second terminal assembly 18, a tubular fuse body 28, and a pull ring 30 mounted to a ferrule 32 at the opposite end of fuse assembly 24. At the end of ferrule 32 is contact assembly 33.

Figure 2:
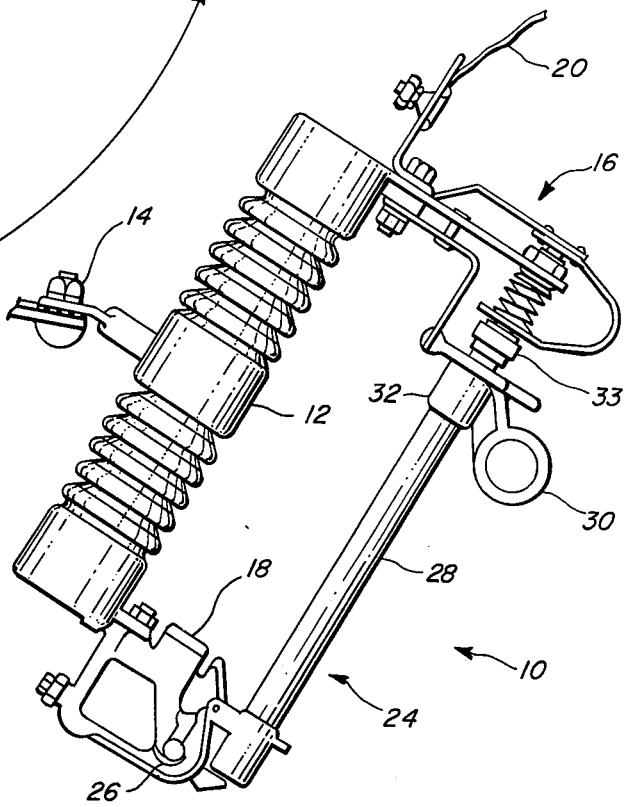
FIG. 2 is a side elevational view of the conventional fuse cutout illustrated in FIG. 1 showing the fuse in a closed position.

FIG. 1 illustrates a fuse assembly 24 in the open position. To close the fuse assembly 24 into the high voltage circuit it is necessary to pivot the fuse assembly in the direction of the arrows illustrated in FIG. 1 until the contact assembly 33 of fuse assembly 24 engages first terminal assembly 16. FIG. 2 illustrates the fuse assembly 24 in the closed position.

Attached to tubular body 28 of fuse assembly 24 is propellant device 40. With reference to FIGS. 3, 4, and 5, propellant device 40 comprises cylindrical body 42 having a nozzle end 44 and a back wall 46 closing the opposite end. Positoned within the hollow interior of cylindrical body 42 is solid rocket fuel 48. Propellant device 40 is a conventional model rocket engine cartridge manufactured by numerous manufacturers and utilized to propel model rockets. For example, a variety of model rocket engines of various sizes are manufactured by Estes Industries of Penrose, Colorado and would be suitable for use in the present invention.

Mounted at the back wall 46 of cylindrical body 42 are gripping fingers 50. Gripping fingers 50 are curved and have free ends 52 that expand and snap around tubular body 28 of fuse assembly 24 thereby holding propellant device 40 firmly against tubular body 28.

At the bottom of cylindrical body 42 is battery housing 54. Battery housing 54 has a hollow interior in which is positioned battery 56 (illustrated by the dotted lines in FIG. 4).

Figure 9:
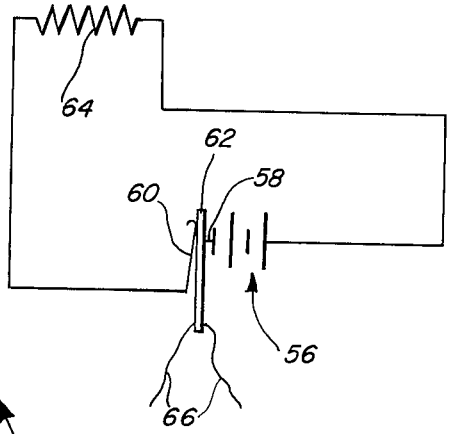
FIG. 9 is a circuit diagram illustrating the battery operated activating means for the rocket engine of the present invention.

With reference to FIGS. 4 and 9, terminal 58 of battery 56 is separated from spring contact 60 by an insulating wafer 62. Battery 56 is connected across heating element 64 so that when insulating wafer 62 is removed, and spring contact 60 contacts terminal 58, current from battery 56 will flow through heating element 64 (imbedded into solid rocket fuel 48) thereby igniting solid rocket fuel 48. Insulating wafer 62 is connected to an insulative cord 66 so that when the end of insulative cord 66 is pulled by a utility lineman, insulating wafer 62 will slide out thereby igniting the solid rocket fuel 48. Insulative cord 66 is also connected to propellant device 40 so that cord 66 can be pulled to remove device 40 from fuse assembly 24 if necessary. Enough slack is provided in insulative cord 66 between insulating wafer 62 and propellant device 40 to assure that insulative cord 66 does not interfere with the movement of fuse assembly 24 after rocket engine ignition.

Operation of the present invention can be illustrated with reference to FIGS. 1, 2, 3, 4, and 5. With the fuse assembly 24 in the open position as illustrated in FIG. 1, the utility lineman attaches the propellant device 40 to the tubular body 28 of fuse assembly 24 as illustrated in FIG. 1. The utility lineman then moves to a remote position unwinding a sufficient length of insulative cord 66. Once remotely located, the utility lineman exerts sufficient force on insulative cord 66 to cause the insulating wafer 62 to slide out from between spring contact 60 and terminal 58 thereby causing current to flow through heating element 64 igniting solid rocket fuel 48. Solid rocket fuel 48 then provides propellant force to cause the fuse assembly 24 to pivot around pivot connection 26 (in the direction of the arrows illustrated in FIG. 1) until fuse assembly 24 engages first terminal assembly 16 thereby closing the fuse into the high voltage circuit. An additional benefit of the present invention is that the propellant forces created by the ignition of solid rocket fuel 48 causes fuse assembly 24 to close into first terminal assembly 16 with such high velocity and with such high force that closing the switching element into a fault is less likely to incur damage to the switching element and contact surfaces.

Formed in the back wall 46 of cylindrical body 42 is indentation 70 (see FIG. 5). Indentation 70 extends through back wall 46 partially through the point where gripping fingers 50 are connected to back wall 46. As rocket fuel 48 burns to the interior of the end wall 46, the heat generated causes the gripping fingers 50 be severed at indentation 70 thereby allowing gripping fingers 50 to spread (see dotted lines in FIG. 5) releasing the expended propellant device 40 from the fuse assembly 24. Thus, it is unnecessary for the lineman to approach the live fuse to remove the propellant device 40. However, if for some reason gripping fingers 50 do not separate far enough for propellant device 40 to disengage from fuse assembly 24, the lineman need only pull on the insulative cord 66 which is attached to propellant device 40 to cause the propellant device 40 to disengage the fuse assembly 24.

FIG. 6 illustrates an alternative embodiment of a connector means for mounting propellant device 40 to the fuse assembly 24. In this embodiment, solid rocket fuel 48 is separated from an ejection charge 49 by a low-thrust, time-delay charge 51. When solid rocket fuel 48 burns to delay charge 51, delay charge 51 ignites and burns until it ignites charge 49. A plug 53 is expelled by ejection charge 49 from an orifice 55 in the end of body 42 propelling body 42 away from tubular body 28 thereby disengaging the device.

FIGS. 7 and 8 illustrate an alternative embodiment of a connector means for mounting the propellant device 40 to the fuse assembly 24. A resilient clip 80 is mounted on the side of propellant device 40 and contoured to engage tubular body 28 of fuse assembly 24 with sufficient gripping force to prevent disengagement when the solid rocket fuel 48 is ignited. Resilient clip 80 has an extended end 82 which is formed to mechanically engage pull ring 30 of fuse assembly 24. The purpose of extended end 82 is to prevent propellant device 40 from pivoting around fuse assembly 24 when the solid rocket fule 48 is ignited so that propellant device 40 is held in the proper alignment to provide propellant force to close the fuse into the high voltage circuit.

Because of the high speed at which propellant device 40 causes fuse assembly 24 to engage first terminal assembly 16, propellant device 40 attains a high momentum. This momentum, when fuse assembly 24 is abruptly stopped by first terminal assembly 16, causes resilient clip 80 to slip over the tubular body 28 of fuse assembly 24 thereby causing propellant device 40 to drop away from fuse assembly 24. Alternatively, an indentation could be provided in the side of cylindrical body 42 adjacent to the point where resilient clip 80 is mounted to cylindrical body 42 thereby allowing the heat generated by the solid rocket fuel 48 to sever the resilient clip 80 so that the propellant device will drop away from fuse assembly 24 after closing.

Figure 11:
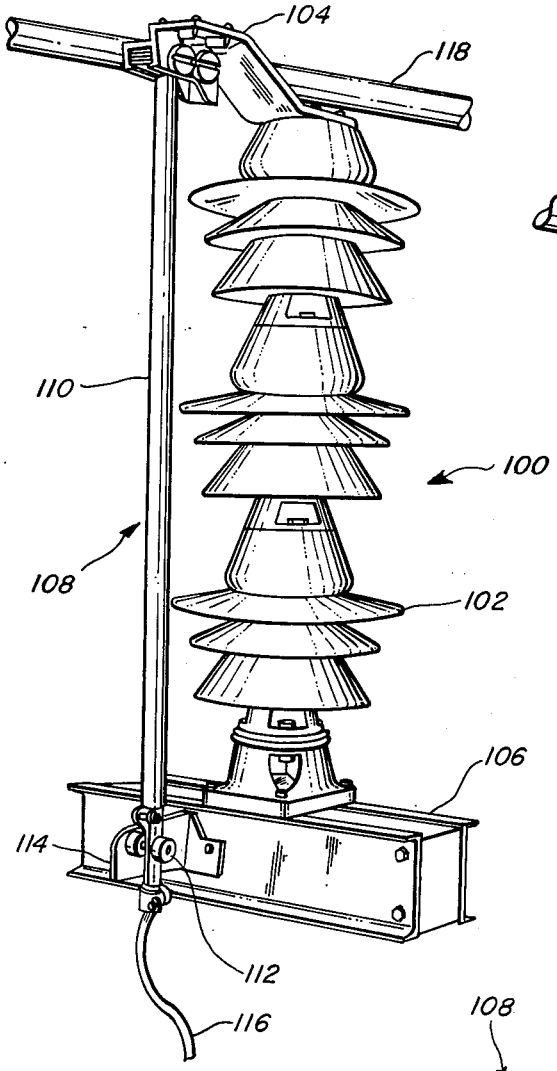
FIG. 11 is a perspective view of the high speed grounding switch illustrated in FIG. 10 showing the switch blade in a closed position.
Figure 10:
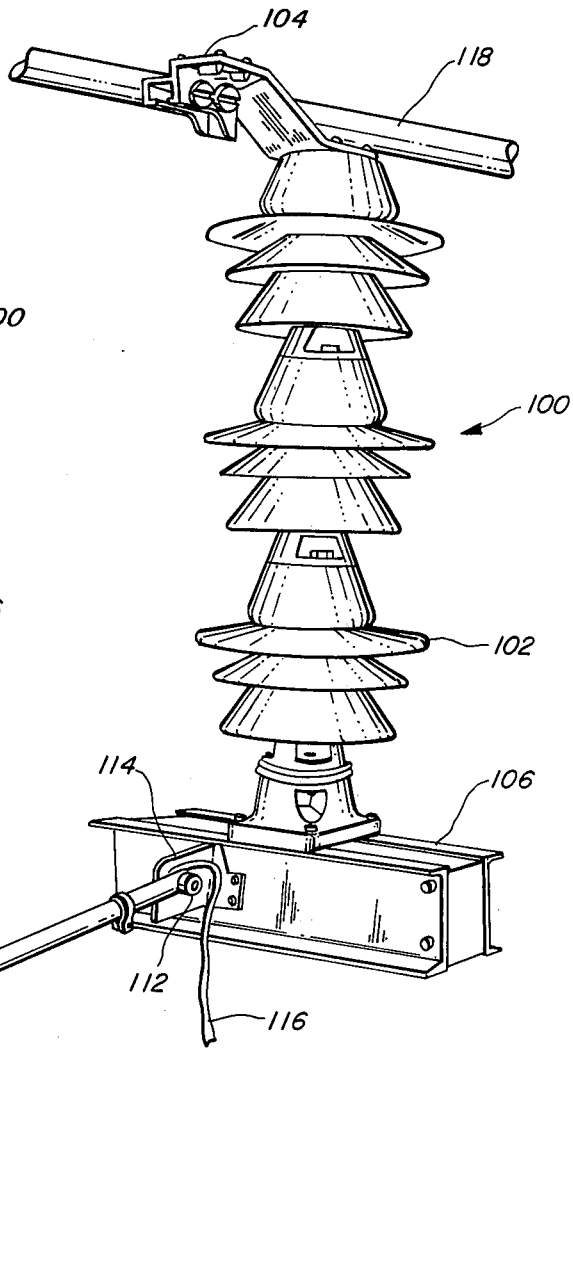
FIG. 10 is a perspective view of a conventional high speed grounding switch with the present invention attached.

With reference to FIGS 10 and 11, a conventional high voltage grounding switch assembly 100 is illustrated. Grounding switch assembly 100 comprises insulator 102 having a contact assembly 104 mounted to the upper end thereof. Mounted at the lower end of insulator 102 is switch base 106 which typically comprises box beam member.

Mounted to switch base 106 is switch blade assembly 108 which comprises switch blade 110 which is pivotably mounted by pin 112 to mounting bracket 114. Mounting bracket 114 is mounted to switch base 106. A grounding cable 116 is attached to the end of switch blade 110 and is connected to a suitable electrical ground (not shown). Connected to contact assembly 104 is station bus 118 which normally conducts high voltage electricity.

Grounding switch assembly 100 (shown without its usual blade-closing mechanism consisting of a charged torsional spring and solenoid release mechanism) is typical of the high-speed grounding switches which are specifically applied to furnish protection to power transformers which would otherwise require more costly devices such as circuit breaker installations. The most popular application of such a grounding switch is for protection of transformers and circuits where the source breakers cannot detect secondary-side faults because such faults are typically limited by the impedance of the transformer to levels below the trip setting of the source breakers. As a less expensive alternative to a local circuit breaker at the transformer, the high-speed grounding switch is actuated by a local relay upon sensing the relatively low-level fault current on the secondary-side of the transformer, thereby imposing a bolted line-to-ground fault on the primary side of the transformer, said fault being heavy enough to actuate the source breakers to clear the fault. Typically, an automatically actuated disconnect switch then opens to isolate the faulted transformer along with the closed high-speed grounding switch, allowing the source breakers to reclose and restore load to the unaffected portions of the system. Obviously, the high speed of the grounding switch in response to the detection of the secondary-side fault, the faster the fault can be cleared and service restored to the remaining poritions of the system. Similarly, an increase in the speed of the grounding switch will diminish damage to equipment caused by the fault current.

Attached to switch blade 110 is propellant device 120 in accordance with the present invention. Propellant device 120 is substantially the same type of propellant device as propellant device 40 previously described. It is evident that the desirable quality of high speed for the grounding switch would be enhanced by either a light weight switch blade or by a propellant device with a heavier thrust, or by a combination of both characteristics. Similiarly, the cost of the switch blade may be reduced by utilizing, for example, aluminum tubing in lieu of the typically-utilized copper tubing fitted with blade tip and contact members designed to withstand closing into a fault. This concept gives rise to yet another variation of the present invention, namely, an expandable blade which is replaced after each operation along with its expended propellant device (made as a unitized element) in the same manner as replacing an expended fuse.

Figure 12:
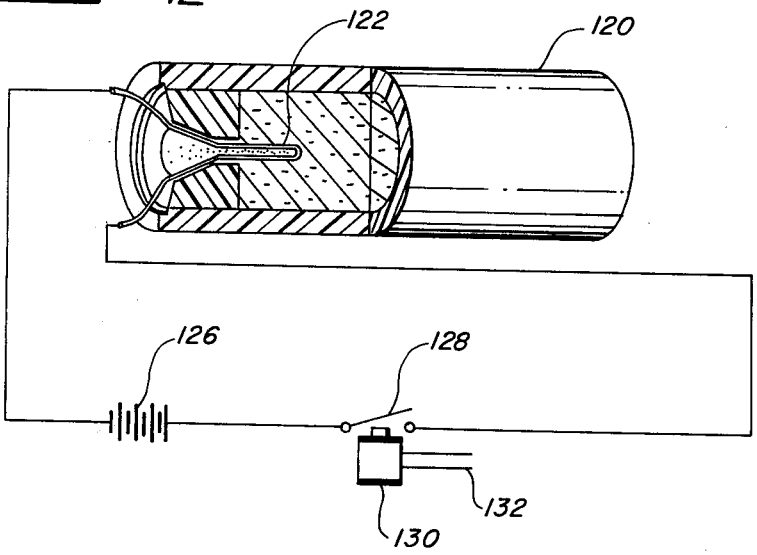
FIG. 12 is a circuit diagram of an alternative embodiment of the battery operated activating means for the rocket engine of the present invention.

With reference to FIG. 12, the activating means for the propellant device 120 shown in FIG. 11 as illustrated. A heating element 122 is imbedded in propellant device 120. Serially connected to the heating element 122 is battery 126 (or other suitable power source) and relay operated switch 128. Relay 130 can be electrically connected by leads 132 to appropriate control circuitry so that switch 128 is closed causing current to flow from battery 126 through heating element 122 when propellant device 120 is to be ignited. For example, an appropriate trip circuit may be provided so that if a secondary side fault current is experienced at the transformer, relay 130 can be operated to fire propellant device 120 thereby closing switch blade 110 into contact assembly 104 (as shown in FIG. 11) thereby grounding station bus 118. Thus, in this embodiment, propellant device 120 provides an extremely high speed inexpensive yet dependable means of operating a grounding switch that avoids the more costly operating mechanisms generally associated with highspeed grounding.

Figure 13:
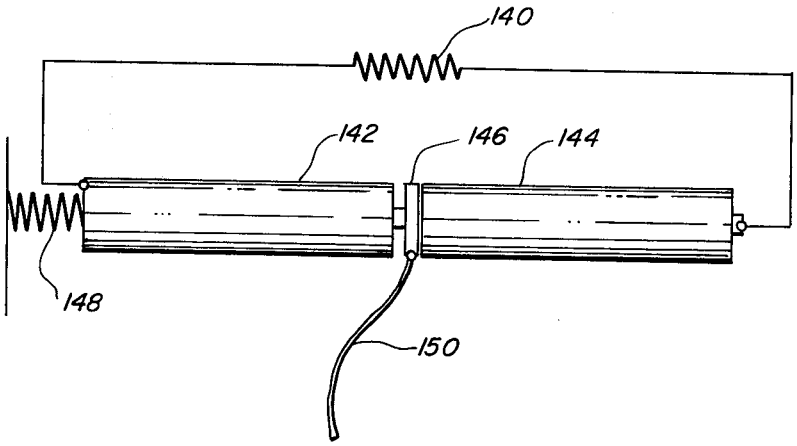
FIG. 13 is a circuit diagram of an alternative embodiment of the battery operated activating means for the rocket engine of the present invention.

With reference to FIG. 13, an alternative embodiment of an activating means for the present invention is illustrated. In this embodiment, heating element 140 is serially connected between batteries 142 and 144. Batteries 142 and 144 are separated by an insulated wafer 146 which prevents current flow. A spring 148 biases battery 142 towards battery 144. Wafer 146 is connected to an insulative cord 150 so that when cord 150 is pulled by utility lineman, wafer 146 can be withdrawn from between batteries 142 and 144 so that an electrical connection is provided. This results in current flow through heating element 140 resulting in ignition of the rocket engine cartridge. The FIG. 13 embodiment provides more rapid heating of the heating element 140 since two batteries 142 and 144 are supplying current to the heating element 140.

It should be expressly understood that the actuating means illustrated in FIGS. 4, 9, 12, and 13 are only examples of many types of ignition arrangements that could be utilized in conjunction with the present invention. For example, even an inexpensive igniting means such as a common fuse cord would be suitable for introducing a time delay for allowing the lineman to attain a remote position prior to the closing of the circuit.

Further, it should be expressly understood that various types of connecting means to connect the propellant device to the driven switching element may be utilized, and the three embodiments illustrated here are only examples of many possible connecting means that may be utilized.

It should also be expressly understood that other types of propellant means than solid fuel rocket engines may be used. For example, a $CO_2$ gas cylinder could also be used to provide the propellant forces.

Further, it should be expressly understood that multiple units of propellant devices may be used in order to attain the required reactive force (thrust) and/or required speed of the switching element.

It should be further understood that various changes, modifications, and variations in the structure and function of the present invention may be affected without departing from the spirit and scope of the present invention as defined in the appended claims.

I claim:

1. A device for causing a switching element of an electrical switching device in an electrical circuit to move the switching element from a first position representative of a first circuit condition to a second position representative of a second circuit condition comprising:

rocket means for being ignited to generate propelling forces to move the switching element from the first position to the second position in response to ignition of said rocket means;

connector means connected to said rocket means for directly and disengageably attaching the rocket means to the switching element so that said rocket means disengages the switching element when the switching element moves to the second position; and activating means for igniting the rocket means in response to remote actuation.

2. A device, as claimed in claim 1, wherein said rocket means is a solid fuel rocket engine.

3. A device, as claimed in claim 1, wherein said connector means comprises a resilient clip member formed in a partial contour of the switching element to disengageably engage the switching element so that the momentum of said rocket means when said rocket means is ignited causes the clip member to bend so that the connected rocket means disengages the switching element when the switching element moves to the second position.

4. A device, as claimed in claim 1, wherein said connector means comprises:

first and second finger members having first and second ends, said first ends being connected to said rocket means, and said second ends being spaced apart to accept and grip the switching element between the first and second finger members; and said rocket means includes means to sever the connection between said first ends of said first and second finger members and said rocket means after said rocket means has been ignited so that said rocket means disengages the switching element after the switching element has moved to the second position.

5. a device, as claimed in claim 1, wherein said rocket means comprises a solid fuel rocket, and said activating means comprises an electrochemical power source, heating means for causing solid fuel rocket to ignite, switch means serially electrically connecting said heating means across said electro-chemical power source, and an insulative cord for closing said switch means from a remote position to cause said heating means to ignite said solid fuel rocket.

6. A device, as claimed in claim 1, wherein said rocket means comprises a solid fuel rocket, and said activating means comprises an electrochemical power source, heating means for causing said solid fuel rocket to ignite, switch means serially electrically connecting said heating means across said electro-chemical power source, and relay means for causing said switch means to operate in response to external activation to cause said heating means to ignite said solid fuel rocket.

7. A device, as claimed in claim 1, further comprising ejecting means for causing said connector means to disengage the switching element after said rocket means generates propellant forces and moves the switching element to the second position.

8. In a conventional high voltage fuse arrangement comprising: a first terminal connected to one portion of an electrical circuit, a second terminal connected to another portion of an electrical circuit, a fuse pivotably mounted at one end to the second terminal so that the fuse can be pivoted to engage the first terminal to connect the fuse across both portions of the electrical circuit; an improved device for closing the fuse into the circuit comprising:

rocket means for being ignited to generate propelling forces to cause the fuse to pivot until it engages the first terminal in response to ignition of said rocket means;

connector means connected to said rocket for disengageably attaching the rocket means to the fuse; and activating means for igniting said rocket means in response to remote actuation.

9. An improved device, as claimed in claim 8, wherein said rocket means is a solid fuel rocket engine.

10. An improved device, as claimed in claim 8, wherein said connector means comprises a resilient clip member formed in a partial contour of the switching element to disengageably engage the fuse so that the momentum of said rocket means when said rocket means is ignited causes the clip member to bend so that the connected rocket means disengages the fuse after the fuse is closed into the circuit.

11. An improved device, as claimed in claim 8, wherein:

said connector means comprises first and second finger members having first and second ends, said first ends being connected to said rocket means, and said second ends being spaced apart to accept and grip the fuse between the first and second finger members; and said rocket means includes means to sever the connection between said first ends of said first and second finger members and said rocket means after said rocket means has been activated so that said rocket means disengages the fuse after the fuse has been closed into the circuit.

12. An improved device, as claimed in claim 8, wherein said rocket means comprises a solid fuel rocket, and said activating means comprises an electro-chemical power source, heating means for causing said solid fuel rocket to ignite, switch means serially electrically connecting said heating means across said electro-chemical power source, and an insulative cord for closing said switch from a remote position to cause said electro-chemical power source to cause said heating means to ignite said solid fuel rocket.

13. In a conventional high-speed grounding switch arrangement including a first terminal connected to a portion of an electrical circuit, a second terminal connected to electrial ground, a switch blade pivotably mounted to the second terminal so that the switch blade can be pivoted to engage the first terminal to ground the first terminal; an improved device for closing the fuse into the circuit comprising:

rocket means for being ignited to generate propelling forces to cause the switch blade to pivot until it engages the first terminal in response to ignition of said rocket means;

connector means connected to said rocket means for disengageably attaching the rocket means to the fuse; and activating means for igniting the rocket means in response to remote actuation.

14. An improved device, as claimed in claim 13, wherein said rocket means comprises a solid fuel rocket, and said activating means comprises an electrochemical power source, heating means for causing said solid fuel rocket to ignite, switch means serially electrically connecting said heating means across said electro-chemical power source, and relay means for causing said switch means to operate in response to external activation to cause said heating means to ignite said solid fuel rocket.

* * * * *

UNITED STATES PATENT AND TRADEMARK OFFICE

CERTIFICATE OF CORRECTION

PATENT NO. : 4,045,762

DATED : August 30, 1977

INVENTOR(S) : John F. Foulkes

It is certified that error appears in the above–identified patent and that said Letters Patent are hereby corrected as shown below:

Column 2, lines 67-68, "expandable" should read "expendable".

Column 6, line 39, "high speed" should read "higher speed".

Column 6, line 43, "an increase" should read "any increase".

Column 9, line 3, "rocket for" should read "rocket means for".

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*